US012053013B2

(12) United States Patent
Langlet et al.

(10) Patent No.: US 12,053,013 B2
(45) Date of Patent: Aug. 6, 2024

(54) METHOD OF MANUFACTURING AN AEROSOL-GENERATING FILM

(71) Applicant: Philip Morris Products S.A., Neuchatel (CH)

(72) Inventors: Delphine Langlet, Neuchatel (CH); Olivier Vegran, Neuchatel (CH); Jean-Yves Vollmer, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 400 days.

(21) Appl. No.: 17/602,055

(22) PCT Filed: Mar. 18, 2020

(86) PCT No.: PCT/EP2020/057523
§ 371 (c)(1),
(2) Date: Oct. 7, 2021

(87) PCT Pub. No.: WO2020/207736
PCT Pub. Date: Oct. 15, 2020

(65) Prior Publication Data

US 2022/0175016 A1 Jun. 9, 2022

(30) Foreign Application Priority Data

Apr. 8, 2019 (EP) ..... 19167979

(51) Int. Cl.
*A24B 15/14* (2006.01)
*A24B 15/167* (2020.01)
*A24B 15/30* (2006.01)
*A24B 15/40* (2006.01)

(52) U.S. Cl.
CPC ..... *A24B 15/167* (2016.11); *A24B 15/14* (2013.01); *A24B 15/302* (2013.01); *A24B 15/40* (2013.01)

(58) Field of Classification Search
None
See application file for complete search history.

(56) References Cited

U.S. PATENT DOCUMENTS

| | | | | |
|---|---|---|---|---|
| 4,008,723 | A | 2/1977 | Borthwick et al. | |
| 5,778,899 | A * | 7/1998 | Saito | A24B 15/10 131/194 |
| 6,109,272 | A * | 8/2000 | Saito | A24B 15/24 131/357 |
| 7,938,125 | B2 | 5/2011 | John et al. | |
| 2005/0244521 | A1 | 11/2005 | Strickland et al. | |
| 2007/0062550 | A1 | 3/2007 | John et al. | |
| 2008/0149121 | A1* | 6/2008 | Wrenn | A24B 15/16 131/369 |
| 2009/0022856 | A1 | 1/2009 | Cheng et al. | |
| 2009/0133703 | A1 | 5/2009 | Strickland et al. | |
| 2009/0133704 | A1 | 5/2009 | Strickland et al. | |
| 2011/0088708 | A1 | 4/2011 | John et al. | |
| 2012/0006343 | A1 | 1/2012 | Renaud et al. | |
| 2012/0199149 | A1 | 8/2012 | Strickland et al. | |
| 2014/0166032 | A1 | 6/2014 | Gindrat | |
| 2018/0199617 | A1 | 7/2018 | Iodice | |
| 2018/0279666 | A1* | 10/2018 | Aoun | A24F 40/46 |
| 2019/0029313 | A1 | 1/2019 | Strickland et al. | |

FOREIGN PATENT DOCUMENTS

| | | | |
|---|---|---|---|
| AU | 2012207021 | A1 | 8/2012 |
| EP | 2 713 778 | A2 | 4/2014 |
| EP | 3 351 121 | A1 | 7/2018 |
| GB | 815315 | A | 6/1959 |
| GB | 1 471 943 | A | 4/1977 |
| JP | 2007-508835 | A | 4/2007 |
| JP | 2007-515950 | A | 6/2007 |
| JP | 2009-523672 | A | 6/2009 |
| JP | 2009-254387 | A | 11/2009 |
| JP | 2015-536688 | A | 12/2015 |
| RU | 2 436 882 | C2 | 12/2011 |
| RU | 2 602 969 | C2 | 11/2016 |
| WO | WO 2011/101164 | A1 | 8/2011 |
| WO | WO 2012/164009 | A2 | 12/2012 |

(Continued)

OTHER PUBLICATIONS

International Search Report and Written Opinion issued on Jun. 17, 2020 in PCT/EP2020/057523 filed on Mar. 18, 2020.
Cristina Mellinas, et al. "Active Edible Films. Current State and Future Trends" University of Alicante, 2015, 32 pages.
Combined Russian Office Action and Search Report issued Jul. 7, 2023 in Russian Patent Application No. 2021130641/03 (with English Translation), citing references 15-17 therein, 15 pages.

(Continued)

*Primary Examiner* — Eric Yaary

(74) *Attorney, Agent, or Firm* — Oblon, McClelland, Maier & Neustadt, L.L.P.

(57) ABSTRACT

A method of manufacturing an aerosol-generating film for generating an aerosol upon heating is provided, including: preparing a film-forming composition including a cellulose based film-forming agent, a non-cellulose based thickening agent, at least about 30 wt percent of water, and at least about 20 wt percent of a polyhydric alcohol being glycerin; forming a layer of the composition less than 1 millimeter thick; and heating the layer to evaporate at least some of the water to obtain the film, the layer being heated to a temperature and for a time such that the film contains less than or equal to about 30 wt percent of water, and the step of preparing the composition further includes dissolving the cellulose based agent and the non-cellulose based thickening agent in the water to form a water-based preparation, defoaming the preparation, and mixing the polyhydric alcohol into the preparation to obtain the composition.

16 Claims, No Drawings

(56) References Cited

FOREIGN PATENT DOCUMENTS

| | | | |
|---|---|---|---|
| WO | WO 2016/023965 | A1 | 2/2016 |
| WO | WO 2018/019543 | A1 | 2/2018 |
| WO | WO 2020/207735 | A1 | 10/2020 |

OTHER PUBLICATIONS

Japanese Notice of Reasons for Refusal mailed on Apr. 1, 2024, issued in Japanese Patent Application No. 2021-559828 filed on Mar. 18, 2020, with English Translation, total 4 pages, citing documents 1, 15-19, therein.

* cited by examiner

METHOD OF MANUFACTURING AN AEROSOL-GENERATING FILM

The present invention relates to a method of manufacturing an aerosol-generating film. Aerosol-generating films obtained by a method in accordance with the present invention may find application as aerosol-generating substrates for producing an inhalable aerosol upon heating, and may therefore be used as components for aerosol-generating articles.

Aerosol-generating articles in which an aerosol-generating substrate, such as a nicotine-containing substrate or a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, often been produced using randomly oriented shreds, strands, or strips of tobacco material. As an alternative, rods for heated aerosol-generating articles formed from gathered sheets of tobacco material have been disclosed, by way of example, in international patent application WO 2012/164009.

International patent application WO 2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In alternative embodiments, the rods of WO 2011/101164 may be formed from strands of homogenised tobacco material obtained by extruding a mixture comprising particulate tobacco and at least one aerosol former to form continuous lengths of homogenised tobacco material.

Alternative forms of substrates comprising nicotine have also been disclosed. By way of example, liquid nicotine compositions, often referred to as e-liquids, have been proposed. These liquid compositions may, for example, be heated by a coiled electrically resistive filament of an aerosol-generating device.

Substrates of this type may require particular care in the manufacture of the containers holding the liquid composition in order to prevent undesirable leakages. To address this issue and simplify the overall manufacturing process, it has also been proposed to provide a gel composition comprising nicotine that generates a nicotine-containing aerosol upon heating. By way of example, WO 2018/019543 discloses a thermoreversible gel composition, that is, a gel that will become fluid when heated to a melting temperature and will set into a gel again at a gelation temperature. The gel is provided within a housing of a cartridge, and the cartridge can be disposed of and replaced when the gel has been consumed.

In order for the gel composition to generate a satisfactory amount of aerosol during use, it is desirable for the gel composition to include a significant amount of an aerosol-former, such as glycerol. However, due to the plasticising qualities of glycerol, it may be difficult to provide a gel composition that provides a good aerosol delivery during use and that is, at the same time, geometrically stable, that is, a gel composition that does not shrink significantly as it solidifies and settles into film form.

Thus, it would be desirable to provide an alternative method of manufacturing an aerosol-generating film that has an improved geometrical stability. It would also be desirable to provide an alternative method of manufacturing an aerosol-generating film that is easy to implement, and which enables the provision of the aerosol-generating film in a variety of forms, such as supported and unsupported, with great precision and control. Additionally, it would be desirable to provide a method of manufacturing one such aerosol-generating film that has a high aerosol-former content, such that the manufactured film can successfully be used as an aerosol-generating substrate in an aerosol-generating article, and such that is easier to dispose of after use or that has reduced environmental impact. It would also be desirable to provide an alternative method of manufacturing an aerosol-generating film that enables an easier adjustment of the aerosol delivery obtainable when heating the manufactured film.

Thus, the present invention relates to a method of manufacturing an aerosol-generating film. The method may comprise a first step of forming a film-forming composition is prepared. The film-forming composition may comprise a cellulose based film-forming agent. Further, the film-forming composition may comprise a non-cellulose based thickening agent. The film-forming composition may additionally contain at least about 30 wt percent of water. In addition, the film-forming composition may contain at least about 10 wt percent of a polyhydric alcohol. The method may comprise a second step in which a layer of the film-forming composition is formed, the layer having a thickness. In a third step, the method may comprise heating the layer of the film-forming composition to evaporate at least some of the water to obtain a film. In the third step, the layer of the film-forming composition may be heated to a temperature and for a time such that the film contains less than about 30 wt percent of water.

According to an aspect of the present invention, there is provided a method of manufacturing a film, the method comprising: preparing a film-forming composition comprising: a cellulose based film-forming agent; a non-cellulose based thickening agent; at least about 30 wt percent of water; and at least about 10 wt percent of a polyhydric alcohol. Further, the method comprises: forming a layer of the film-forming composition, the layer having a thickness; heating the layer of the film-forming composition to evaporate at least some of the water to obtain a film, wherein the layer of the film-forming composition is heated to a temperature and for a time such that the film contains less than about 30 wt percent of water.

As used herein, the term "film" is used to describe a solid laminar element having a thickness that is less than the width or length thereof.

The film may be self-supporting. In other words, a film may have cohesion and mechanical properties such that the film, even if obtained by casting a film-forming formulation on a support surface, can be separated from the support surface.

Alternatively, the film may be disposed on a support or sandwiched between other materials. This may enhance the mechanical stability of the film.

In the context of the present invention the term "cellulose based film-forming agent" is used to describe a cellulosic polymer capable, by itself or in the presence of an auxiliary thickening agent, of forming a continuous film.

As used herein with reference to the invention, the term "non-cellulose based thickening agent" is used to describe a non-cellulosic substance that, when added to an aqueous or non-aqueous liquid composition, increases the viscosity of the liquid composition without substantially modifying its other properties. The thickening agent may increase stability, and improve suspension of components in the liquid composition. A thickening agent may also be referred to as a "thickener" or a "rheology modifier".

The term "aerosol generating article" is used herein to denote an article wherein an aerosol generating substrate is heated to produce and deliver an aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as a tobacco-based substrate or a substrate containing an aerosol-former and a flavouring.

Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention may find particular application in aerosol generating systems comprising an electrically heated aerosol generating device having an internal heater blade which is adapted to supply heat to a film.

As used herein, the term "aerosol generating device" refers to a device comprising a heater element that interacts with an aerosol-generating film in accordance with the invention to produce an aerosol. During use, volatile compounds are released from the aerosol-generating film by heat transfer and entrained in air drawn through the aerosol generating article. As the released compounds cool they condense to form an aerosol that is inhaled by the consumer.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating film of the invention is also an aerosol former within the meaning set out above.

The term "exposed surface area of the film" is used herein to denote the cumulative surface area of the various surfaces of an aerosol-generating film in accordance with the invention that, during use, may become exposed to the gaseous airflow through the aerosol-generating article containing the film.

The term "thickness of a film" is used in the present specification to denote the minimum distance measured between opposite, substantially parallel surfaces of a film.

The thickness of the aerosol-generating film may substantially correspond to the thickness to which a corresponding film-forming composition is cast or extruded, as the cast or extruded film-forming composition substantially does not contract during drying, despite the loss of water.

The "weight of a film" in accordance with the invention will generally correspond to the weight of the components of the corresponding film-forming composition minus the weight of water evaporated during the drying step. If a film is self-supporting, the film can be weighed on its own. If a film is disposed on a support, the film and the support may be weighed and the weight of the support, measured prior to deposition of the film, is subtracted from the combined weight of the film and the support.

Unless stated otherwise, percentages by weight (which are identified herein by the expression "wt percent") of components of the aerosol-generating film recited herein are based on the total weight of the aerosol-generating film.

In contrast to existing aerosol-generating films as well as known orally dissolvable, nicotine-containing films, in the films obtained by methods in accordance with the invention a cellulose based film-forming agent (preferably HPMC) is combined with a non-cellulose based thickening agent and a polyhydric alcohol (preferably glycerin). It has been observed that significant amounts of a polyhydric alcohol such as glycerin—which is often included in film-forming compositions as a plasticiser—may adversely impact the geometric stability of the composition when it is cast on a support surface and dried to form the film. The inventors have surprisingly found that use of a cellulose based film-forming agent in combination with a non-cellulose based thickening agent may counter such effect, such that it is easier to form films with predetermined geometric parameters (for example, thickness, surface area, etc.) with high precision and repeatability.

In particular, as will be explained in more detail below, the inventors have surprisingly found that aerosol-generating films obtained by methods in accordance with the invention that comprise 6 wt percent or more of a cellulose based film-forming agent, and preferably HPMC, are especially stable. Thus, they substantially maintain their shape and mass when exposed to a variety of environmental conditions, such as a change in relative humidity from 10 percent to 60 percent. Accordingly, aerosol-generating films obtain by methods in accordance with the invention may advantageously not release a liquid phase during storage or transportation.

Further, when heated in an aerosol-generating device, aerosol-generating films obtained by methods in accordance with the present invention may release an aerosol containing the polyhydric alcohol and, where present, an alkaloid compound, such as nicotine, without substantially releasing a liquid phase.

Thus, a method in accordance with the invention advantageously provides a film having a significant polyhydric alcohol content that can easily be cast or extruded and solidified starting from a composition having a gel-like texture. As significant percentages of the polyhydric alcohol, particularly glycerin, can be provided in film form, whilst at the same time being able to finely control the geometry of the film, the invention advantageously provides a film that may find use as an aerosol-generating substrate in an aerosol-generating article designed to be heated to release the aerosol.

Upon heating, most of the components of the film essentially evaporate. In effect, it has been observed that only some residue of the cellulose based film-forming agent is typically left following use. As such, aerosol-generating articles incorporating substrates comprising a film in accordance with the invention may be easier to dispose of, and may have an improved environmental impact.

In addition, the inventors have surprisingly found that films in accordance with the invention may display tensile strength values that make them suitable for use as self-supporting substrates in an aerosol-generating article. This makes them versatile and advantageously adapted to be provided in a variety of shapes and arrangements within an aerosol-generating article.

By adjusting parameters such as thickness, exposed surface area of the film, or content of species such as nicotine or other alkaloid compounds, or plant material or plant extracts or flavourants within the film, it is possible to finely control the delivery of said species in aerosol form to a consumer.

Further, methods in accordance with the invention can be implemented both as batch processes and as continuous processes and can be automated, which allows them to be conveniently incorporated into existing production lines for the manufacture of heated aerosol-generating articles at high speed. Accordingly, solid aerosol-generating films can easily be formed in a controlled and consistently reproducible manner.

As described briefly above, a method in accordance with the invention comprises a step of preparing a film-forming composition comprising: a cellulose based film-forming agent; a non-cellulose based thickening agent; at least about 30 wt percent of water; and at least about 10 wt percent of a polyhydric alcohol.

To this purpose, the cellulose based film-forming agent and the thickening agent may first be dissolved into water. Preferably, heat is supplied to the aqueous mixture or the aqueous mixture is agitated or both, with a view to facilitating the achievement of full dissolution. Preferably, heat is supplied to the aqueous mixture or the aqueous mixture is agitated or both, with a view to facilitating the achievement of full dissolution. In a subsequent step the polyhydric alcohol is added, optionally along with other components as will be described in more detail below. The film-forming composition thus obtained is then applied on a support surface, such as for example by casting or extrusion, and left to gellify, preferably at room temperature. Water is then evaporated by supplying heat to the applied film-forming composition. This effectively amounts to a drying step, during which the water content of the applied film-forming composition is lowered to obtain the aerosol-generating film until the film contains 30 wt percent or less of water. The film may then be detached from the support surface.

An aerosol-generating film obtained by the method will typically comprise the cellulose based film-forming agent; the non-cellulose based thickening agent; water accounting for less than about 30 wt percent of the film; and the polyhydric alcohol, which will accounts for at least about 40 wt percent of the film.

Preferably, in an aerosol-generating film in accordance with the invention the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

More preferably, in an aerosol-generating film in accordance with the invention, the cellulose based film-forming agent is selected from the group consisting of hydroxypropyl methylcellulose (HPMC), methylcellulose (MC), ethylcellulose (EC), and combinations thereof.

In particularly preferred embodiment, the cellulose based film-forming agent is HPMC. In methods in accordance with the present invention, the film-forming composition may comprise at least about 1 wt percent of a cellulose based film-forming agent. In methods in accordance with the present invention, the film-forming composition may comprise up to about 65 wt percent of a cellulose based film-forming agent. In methods in accordance with the present invention, the film-forming composition may comprise from about 1 wt percent to about 65 wt percent of a cellulose based film-forming agent.

Preferably, the film-forming composition comprises at least about 2 wt percent of a cellulose based film-forming agent. More preferably, the film-forming composition comprises at least about 3 wt percent of a cellulose based film-forming agent. Even more preferably, the film-forming composition comprises at least about 4 wt percent of a cellulose based film-forming agent. Most preferably, the film-forming composition comprises at least about 5 wt percent of a cellulose based film-forming agent.

The film-forming composition preferably comprises less than or equal to about 20 wt percent of a cellulose based film-forming agent. More preferably, the film-forming composition comprises less than or equal to about 15 wt weight of a cellulose based film-forming agent. Even more preferably, the film-forming composition comprises less than or equal to about 10 wt percent of a cellulose based film-forming agent.

In some preferred embodiments, the film-forming composition comprises from about 2 wt percent to about 20 wt percent of a cellulose based film-forming agent. More preferably, the film-forming composition comprises from about 3 wt percent to about 15 wt percent of a cellulose based film-forming agent. Even more preferably, the film-forming composition comprises from about 4 wt percent to about 10 wt percent of a cellulose based film-forming agent.

In preferred embodiments, the film-forming composition comprises at least about 2 wt percent of HPMC. More preferably, the film-forming composition comprises at least about 3 wt percent of HPMC. Even more preferably, the film-forming composition comprises at least about 4 wt percent of HPMC. Most preferably, the film-forming composition comprises at least about 5 wt percent of HMPC.

The film-forming composition preferably comprises less than or equal to about 20 wt percent of HPMC. More preferably, the film-forming composition comprises less than or equal to about 15 wt weight of HPMC. Even more preferably, the film-forming composition comprises less than or equal to about 10 wt percent of HPMC.

In some preferred embodiments, the film-forming composition comprises from about 2 wt percent to about 20 wt percent of HPMC. More preferably, the film-forming composition comprises from about 3 wt percent to about 15 wt percent of HPMC. Even more preferably, the film-forming composition comprises from about 4 wt percent to about 10 wt percent of HPMC.

In the film-forming composition for a method in accordance with the invention the non-cellulose based thickening agent may be selected from the group consisting of agar, xanthan gum, alginate, gellan gum, carrageenan, guar gum, gum Arabic, locust bean gum, pectins, starches, and combinations thereof.

Preferably, in the film-forming composition of a method in accordance with the invention the non-cellulose based thickening agent is selected from the group consisting of agar, xanthan gum, alginate, and combinations thereof. In preferred embodiments, the non-cellulose based thickening agent is agar.

In methods in accordance with the present invention, the film-forming composition may comprise up to about 45 wt percent of a non-cellulose based thickening agent.

Preferably, the film-forming composition comprises at least about 0.2 wt percent of a non-cellulose based thickening agent. More preferably, the film-forming composition comprises at least about 0.3 wt percent of a non-cellulose based thickening agent. Even more preferably, the film-forming composition comprises at least about 0.5 wt percent of a non-cellulose based thickening agent. In addition, or as an alternative, the film-forming composition preferably comprises less than or equal to about 10 wt percent of a non-cellulose based thickening agent.

More preferably, the film-forming composition comprises less than or equal to about 5 wt percent of a non-cellulose based thickening agent. Even more preferably, the film-forming composition comprises less than or equal to about 2 wt percent of a non-cellulose based thickening agent.

In some preferred embodiments, the film-forming composition comprises from about 0.2 wt percent to about 10 wt percent of a non-cellulose based thickening agent. More preferably, the film-forming composition comprises from about 0.3 wt percent to about 5 wt percent of a non-cellulose based thickening agent. Even more preferably, the film-forming composition comprises from about 0.5 wt percent to about 2 wt percent of a non-cellulose based thickening agent.

In preferred embodiments, the film-forming composition comprises at least about 0.2 wt percent of agar. More preferably, the film-forming composition comprises at least about 0.3 wt percent of agar. Even more preferably, the film-forming composition comprises at least about 0.5 wt percent of agar. In addition, or as an alternative, the film-forming composition preferably comprises less than or equal to about 10 wt percent of agar. More preferably, the film-forming composition comprises less than or equal to about 5 wt percent of agar. Even more preferably, the film-forming composition comprises less than or equal to about 2 wt percent of agar.

In some preferred embodiments, the film-forming composition comprises from about 0.2 wt percent to about 10 wt percent of agar. More preferably, the film-forming composition comprises from about 0.3 wt percent to about 5 wt percent of agar. Even more preferably, the film-forming composition comprises from about 0.5 wt percent to about 2 wt percent of agar.

Polyhydric alcohols suitable as aerosol-formers include, but are not limited to, propylene glycol, triethylene glycol, 1,3-butanediol, and glycerin. Preferably, in an aerosol-generating film in accordance with the invention the polyhydric alcohol is selected from the group consisting of glycerin, propylene glycol, and combinations thereof. In particularly preferred embodiments the polyhydric alcohol is glycerin.

As set out briefly above, in a method in accordance with the present invention the film-forming composition contains at least about 10 wt percent of a polyhydric alcohol. More preferably, the aerosol-generating film comprises at least about 15 wt percent of a polyhydric alcohol. Even more preferably, the aerosol-generating film comprises at least about 20 wt percent of a polyhydric alcohol.

In addition, or as an alternative, the aerosol-generating film preferably comprises less than or equal to about 90 wt percent of a polyhydric alcohol. More preferably, the aerosol-generating film preferably comprises less than or equal to about 85 wt percent of a polyhydric alcohol. Even more preferably, the aerosol-generating film preferably comprises less than about 80 wt percent of a polyhydric alcohol. In some preferred embodiments, the aerosol-generating film preferably comprises less than or equal to about 75 wt percent of a polyhydric alcohol, more preferably less than or equal to about 70 wt percent of a polyhydric alcohol, even more preferably less than or equal to about 65 wt percent of a polyhydric alcohol. In some particularly preferred embodiments, the aerosol-generating film comprises less than or equal to about 60 wt percent of a polyhydric alcohol.

In preferred embodiments, in a method in accordance with the present invention the film-forming composition contains at least about 10 wt percent of glycerin. More preferably, the aerosol-generating film comprises at least about 15 wt percent of glycerin. Even more preferably, the aerosol-generating film comprises at least about 20 wt percent of glycerin.

In addition, or as an alternative, the aerosol-generating film preferably comprises less than or equal to about 90 wt percent of glycerin. More preferably, the aerosol-generating film preferably comprises less than or equal to about 85 wt percent of glycerin. Even more preferably, the aerosol-generating film preferably comprises less than about 80 wt percent of glycerin. In some preferred embodiments, the aerosol-generating film preferably comprises less than or equal to about 75 wt percent of glycerin, more preferably less than or equal to about 70 wt percent of glycerin, even more preferably less than or equal to about 65 wt percent of a polyhydric alcohol. In some particularly preferred embodiments, the aerosol-generating film comprises less than or equal to about 60 wt percent of glycerin.

Preferably, in the film-forming composition a ratio between the weight of cellulose based film-forming agent and the weight of polyhydric alcohol is at least about 0.1, more preferably at least about 0.2, even more preferably about 0.3. In addition, or as an alternative, in the film-forming composition a ratio between the weight of cellulose based film-forming agent and the weight of polyhydric alcohol is preferably less than or equal to about 1.

In preferred embodiments of the method, in the film-forming composition a ratio between the weight of cellulose based film-forming agent and the weight of polyhydric alcohol is from about 0.1 to about 1.

In some particularly preferred embodiments, the film-forming composition comprises from about 1 gram of HPMC to about 10 grams of HPMC per 10 grams of glycerin.

Preferably, in the film-forming composition a ratio between the weight of non-cellulose based thickening agent and the weight of polyhydric alcohol is at least about 0.05, more preferably at least 0.1, even more preferably at least 0.2. In addition, or as an alternative, in the film-forming composition a ratio between the weight of non-cellulose based thickening agent and the weight of polyhydric alcohol is preferably less than or equal to about to 0.5.

In preferred embodiments of the method, in the film-forming composition a ratio between the weight of non-cellulose based thickening agent and the weight of polyhydric alcohol is from about 0.1 to about 0.5.

In some particularly preferred embodiments, the film-forming composition comprises from 0.5 grams of agar to about 5 grams of agar per 10 grams of glycerin.

In some embodiments, the film-forming composition comprises an alkaloid compound or a cannabinoid compound or both.

As used herein with reference to the invention, the term "alkaloid compound" is used to describe any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In the context of the present invention, the term "alkaloid compounds" is used to describe both naturally derived alkaloid compounds and synthetically manufactured alkaloid compounds.

Suitable alkaloid compounds for use in a film-forming composition for use in a method accordance with the invention include nicotine and anatabine.

As used herein with reference to the invention, the term "cannabinoid compound" is used to describe any one of a class of naturally occurring compounds that are found in parts of the *cannabis* plant—namely the species *Cannabis sativa, Cannabis indica*, and *Cannabis ruderalis*. Cannabinoid compounds are especially concentrated in the female flower heads. Cannabinoid compounds naturally occurring the in *cannabis* plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

Cannabinoid compounds suitable for use in a film-forming composition for use in a method in accordance with the invention include tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT).

In general, the film-forming composition for use in a method for use in a method in accordance with the invention may comprise up to about 10 wt percent of an alkaloid compound or a cannabinoid compound or both. In view of applications of the aerosol-generating film obtained by a method of the invention as a substrate in an aerosol-generating article, this is advantageous as the content of alkaloid compound or cannabinoid compound or both in the film may be increased and adjusted with a view to optimising the delivery of alkaloid compound or cannabinoid compound or both in aerosol form to the consumer. Compared with existing aerosol-generating substrates based on the use of plant material, this may advantageously allow for higher contents of alkaloid compound or cannabinoid compound or both per volume of substrate (film) or per weight of substrate (film), which may be desirable from a manufacturing viewpoint.

Preferably, the film-forming composition comprises at least about 0.1 wt percent of an alkaloid compound or a cannabinoid compound or both. Thus, the aerosol-generating film preferably comprises at least about 0.1 wt percent of an alkaloid compound or at least 0.1 wt percent of a cannabinoid compound or at least about 0.1 wt percent of a combination of an alkaloid compound and a cannabinoid compound.

More preferably, the film-forming composition comprises at least about 0.2 wt percent of an alkaloid compound or a cannabinoid compound or both. Even more preferably, the film-forming composition comprises at least about 0.3 wt percent of an alkaloid compound or a cannabinoid compound or both. In addition, or as an alternative, the film-forming composition preferably comprises less than or equal to about 10 wt percent of an alkaloid compound or a cannabinoid compound or both. More preferably, the film-forming composition comprises less than or equal to about 5 wt percent of an alkaloid compound or a cannabinoid compound or both. Even more preferably, the film-forming composition comprises less than or equal to about 3 wt percent of an alkaloid compound or a cannabinoid compound or both. Most preferably, film-forming composition comprises less than or equal to about 2 wt percent of an alkaloid compound or a cannabinoid compound or both. In some embodiments, the film forming composition comprises from about 0.1 wt percent nicotine to about 10 wt percent of an alkaloid compound or a cannabinoid compound or both. More preferably, the film forming composition comprises from about 0.2 wt percent to about 5 wt percent of an alkaloid compound or a cannabinoid compound or both. Even more preferably, the film forming composition comprises from about 0.3 wt percent to about 3 wt percent of an alkaloid compound or a cannabinoid compound or both.

In some embodiments, the film-forming composition comprises one or more of a cannabinoid and an alkaloid compound comprising nicotine or anatabine.

In some preferred embodiments of the method, the film-forming composition comprises nicotine.

As used herein with reference to the invention, the term "nicotine" is used to describe nicotine, a nicotine base or a nicotine salt. In embodiments in which the aerosol-generating film comprises a nicotine base or a nicotine salt, the amounts of nicotine recited herein are the amount of free base nicotine or amount of protonated nicotine, respectively.

The aerosol-generating film may comprise natural nicotine or synthetic nicotine.

The aerosol-generating film may comprise one or more monoprotic nicotine salts.

As used herein with reference to the invention, the term "monoprotic nicotine salt" is used to describe a nicotine salt of a monoprotic acid.

In general, the film-forming composition may comprise up to about 10 wt percent nicotine. In view of applications of the aerosol-generating film obtained by a method in accordance with the invention as a substrate in an aerosol-generating article, this is advantageous as the content of nicotine in the film may be increased and adjusted with a view to optimising the delivery of nicotine in aerosol form to the consumer. Compared with existing aerosol-generating substrates based on the use of tobacco plant, this may advantageously allow for higher contents of nicotine per volume of substrate (film) or per weight of substrate (film), which may be desirable from a manufacturing viewpoint.

If the film is to be used as an aerosol-generating substrate, it is advantageously possible to increase and control the content of nicotine per volume/weight of film (substrate) with a view to optimising the delivery of nicotine in aerosol form. Compared with aerosol-generating substrates based on the use of tobacco plant, this may allow for higher contents of nicotine per volume/weight of film.

Preferably, the film-forming composition comprises at least about 0.1 wt percent nicotine. More preferably, the film-forming composition comprises at least about 0.2 wt percent nicotine. Even more preferably, the film-forming composition comprises at least about 0.3 wt percent nicotine. In addition, or as an alternative, the film-forming composition preferably comprises less than or equal to about 10 wt percent nicotine. More preferably, the film-forming composition comprises less than or equal to about 5 wt percent nicotine. Even more preferably, the film-forming composition comprises less than or equal to about 3 wt percent nicotine. Most preferably, film-forming composition comprises less than or equal to about 2 wt percent nicotine. In some embodiments, the film forming composition comprises from about 0.1 wt percent nicotine to about 10 wt percent nicotine. More preferably, the film forming composition comprises from about 0.2 wt percent nicotine to about 5 wt percent nicotine. Even more preferably, the film forming composition comprises from about 0.3 wt percent nicotine to about 3 wt percent nicotine.

In some preferred embodiments, the film-forming comprises a cannabinoid compound. Preferably, the cannabinoid compound is selected from CBD and THC. More preferably, the cannabinoid compound is CBD.

The film-forming composition for use in a method in accordance with the invention may comprise up to about 10 wt percent of CBD. Preferably, the film-forming composition comprises at least about 0.5 wt percent CBD. More preferably, the film-forming composition comprises at least about 1 wt percent CBD. Even more preferably, the film-forming composition comprises at least about 2 wt percent CBD. In addition, or as an alternative, the film-forming composition preferably comprises less than about 6 wt percent CBD. More preferably, the film-forming composition comprises less than about 5 wt percent CBD. Even more preferably, the film-forming composition comprises less than about 4 wt percent CBD.

In preferred embodiments, the film-forming composition comprises from about 0.5 wt percent to about 10 wt percent CBD, more preferably from about 1 wt percent to about 6 wt percent CBD, even more preferably from about 2 wt percent to about 5 wt percent CBD.

The film-forming composition may be a substantially tobacco-free film-forming composition. As used herein with reference to the invention, the term "substantially tobacco-free film forming composition" describes a film-forming composition having a tobacco content of less than 1 wt percent. For example, the film-forming composition may have a tobacco content of less than about 0.75 wt percent, less than about 0.5 wt percent or less than about 0.25 wt percent.

The film-forming composition may be a tobacco-free film-forming composition.

As used herein with reference to the invention, the term "tobacco-free film-forming composition" describes a film-forming composition having a tobacco content of 0 wt percent.

In some embodiments, the film-forming composition comprises tobacco material or a non-tobacco plant material or a plant extract. By way of example, the film-forming composition may comprise tobacco particles, such as tobacco lamina particles, as well as particles of other botanicals, such as clove and *eucalyptus*.

In preferred embodiments, the film-forming composition comprises an acid. More preferably, the aerosol-generating film comprises one or more organic acids. Even more preferably, the aerosol-generating film comprises one or more carboxylic acids. In particularly preferred embodiments, the acid is lactic acid or levulinic acid.

The inclusion of an acid is especially preferred in embodiments of the method where the film-forming composition comprises nicotine, as it has been observed that the presence of an acid may stabilise dissolved species in the film-forming composition, such as with nicotine and other plant extracts. Without wishing to be bound by theory, it is understood that the acid may interact with the nicotine molecule, especially where nicotine is provided in salt form, and this substantially prevents nicotine from evaporating during the drying operation. As such, the loss of nicotine during manufacturing of the film can be minimised, and higher, better controlled nicotine delivery to the consumer can advantageously be ensured.

Preferably, the film-forming composition comprises at least about 0.1 wt percent of an acid. More preferably, the film-forming composition comprises at least about 0.25 wt percent of an acid. Even more preferably, the film-forming composition comprises at least about 0.5 wt percent of an acid. In addition, or as an alternative, the film-forming composition preferably comprises less than or equal to 2 wt percent of an acid. More preferably, the film-forming composition comprises less than or equal to 1.5 wt percent of an acid. Even more preferably, the film-forming composition comprises less than or equal to 1 wt percent of an acid.

In preferred embodiments, the film-forming composition comprises from about 0.1 wt percent to about 2 wt percent of an acid. More preferably, the film-forming composition comprises from about 0.25 wt percent to about 1.5 wt percent of an acid. Even more preferably, the film-forming composition comprises from about 0.5 wt percent to about 1 wt percent of an acid.

In preferred embodiments, the film-forming composition comprises at least about 0.1 wt percent of levulinic acid. More preferably, the film-forming composition comprises at least about 0.25 wt percent of levulinic acid. Even more preferably, the film-forming composition comprises at least about 0.5 wt percent of levulinic acid. In addition, or as an alternative, the film-forming composition preferably comprises less than or equal to 2 wt percent of levulinic acid. More preferably, the film-forming composition comprises less than or equal to 1.5 wt percent of levulinic acid. Even more preferably, the film-forming composition comprises less than or equal to 1 wt percent of levulinic acid.

In preferred embodiments, the film-forming composition comprises from about 0.1 wt percent to about 2 wt percent of levulinic acid. More preferably, the film-forming composition comprises from about 0.25 wt percent to about 1.5 wt percent of levulinic acid. Even more preferably, the film-forming composition comprises from about 0.5 wt percent to about 1 wt percent of levulinic acid.

In preferred embodiments, the film-forming composition comprises at least about 0.1 wt percent of lactic acid. More preferably, the film-forming composition comprises at least about 0.25 wt percent of lactic acid. Even more preferably, the film-forming composition comprises at least about 0.5 wt percent of lactic acid. In addition, or as an alternative, the film-forming composition preferably comprises less than or equal to 2 wt percent of lactic acid. More preferably, the film-forming composition comprises less than or equal to 1.5 wt percent of lactic acid. Even more preferably, the film-forming composition comprises less than or equal to 1 wt percent of lactic acid.

In preferred embodiments, the film-forming composition comprises from about 0.1 wt percent to about 2 wt percent of lactic acid. More preferably, the film-forming composition comprises from about 0.25 wt percent to about 1.5 wt percent of lactic acid. Even more preferably, the film-forming composition comprises from about 0.5 wt percent to about 1 wt percent of lactic acid.

The film-forming composition may optionally comprise a flavourant. In some embodiments, the film-forming composition may comprise up to about 2 wt percent of a flavourant. By way of example, the film-forming composition may comprise menthol. Other suitable flavourants may include one or more of terpenes, terpenoids, eugenol, eucalyptol.

In particularly preferred embodiments, the film-forming composition consists of: from about 3 wt percent to about 6 wt percent HPMC; from about 0.5 wt percent to about 2 wt percent agar; from about 0.1 wt percent to about 2 wt percent nicotine; from about 0.1 wt percent to about 1 wt percent of an acid; from about 10 wt percent to about 20 wt percent glycerin; and balance water.

In some embodiments, the step of preparing a film-forming composition comprises mixing with water a preparatory formulation, wherein the preparatory formulation may comprise the cellulose based film-forming agent, the non-cellulose based thickening agent, and the polyhydric alcohol. The preparatory formulation preferably comprises less than 10 wt percent of water, more preferably less than 5 wt percent of water, even more preferably less than 1 wt percent of water.

The preparatory formulation may be prepared by mixing the cellulose based film-forming agent, the non-cellulose based thickening agent, and the polyhydric alcohol. The inventors have found that the following manufacturing steps may desirably help to prepare a homogenised film-forming composition with a low amount of air trapped within the film-forming composition.

The film-forming composition may be prepared by mixing the preparatory formulation with water under vacuum. Preferably, the film-forming composition is prepared by mixing the preparatory formulation with water at a pressure less than or equal to −0.1 bar (ambient atmospheric pressure being set as the zero point), more preferably less than or equal to −0.2 bar, even more preferably less than or equal to −0.5 bar. Most preferably, the film-forming composition is prepared by mixing the preparatory formulation with water under substantially total vacuum.

The film-forming composition may be prepared by mixing the preparatory formulation with water at a low shear rate. The film-forming composition may be prepared by mixing under vacuum the preparatory formulation with water at a low shear rate.

A low shear mixing rate may be at a speed of less than or equal to 200 rpm, preferably less than or equal to 100 rpm. In some preferred embodiments, a low shear mixing rate may be about 40 rpm.

The film-forming composition may be prepared by mixing the preparatory formulation with water first at a low shear rate for a first period of time and then at a high shear rate for a second period of time. The film-forming composition may be prepared by mixing under vacuum the preparatory formulation with water first at a low shear rate for a first period of time and then at a high shear rate for a second period of time.

A high shear mixing rate may be at a speed of at least about 500 rpm, preferably at least about 1000 rpm. In some preferred embodiments, a high shear mixing rate may be about 2000 rpm.

The film-forming composition may be prepared by mixing the preparatory formulation with water first at a high shear rate and then at a low shear rate. The film-forming composition may be prepared by mixing under vacuum the preparatory formulation with water first at a high shear rate and then at a low shear rate.

The film-forming composition may be prepared by mixing the preparatory formulation with water at a low shear rate for a first period of time, then at a high shear rate for a second period of time, then at a low shear rate for a third period of time. The film-forming composition may be prepared by mixing under vacuum the preparatory formulation with water at a low shear rate for a first period of time, then at a high shear rate for a second period of time, and then at a low shear rate for a third period of time.

The film-forming composition may be prepared by mixing the preparatory formulation with water at a low shear rate for a first period, then at a high shear rate for a second period, then at a low shear rate for a third period. The film-forming composition may be prepared by mixing under vacuum the preparatory formulation with water at a low shear rate for at least one minute, then at a high shear rate for at least five minutes, and then at a low shear rate for at least 30 minutes. The film-forming composition may be prepared by mixing under vacuum the preparatory formulation with water at a low shear rate for about two minutes, then at a high shear rate for about 15 minutes, and then at a low shear rate for about three hours.

Preferably, in the step of heating the layer of the film-forming composition to evaporate at least some of the water to obtain a film the layer of the film-forming composition is heated to a temperature and for a time such that the film contains at least about 40 wt percent of the polyhydric alcohol.

More preferably, in the step of heating the layer of the film-forming composition to evaporate at least some of the water to obtain a film the layer of the film-forming composition is heated to a temperature and for a time such that the film contains at least about 42 wt percent of the polyhydric alcohol, even more preferably at least about 44 wt percent of the polyhydric alcohol.

In addition, or as an alternative, in the step of heating the layer of the film-forming composition to evaporate at least some of the water to obtain a film the layer of the film-forming composition is heated to a temperature and for a time such that the film contains less than or equal to about 90 wt percent of the polyhydric alcohol. More preferably, in the step of heating the layer of the film-forming composition to evaporate at least some of the water to obtain a film the layer of the film-forming composition is heated to a temperature and for a time such that the film contains less than or equal to about 85 wt percent of the polyhydric alcohol, even more preferably less than or equal to 80 wt percent of the polyhydric alcohol. In some preferred embodiments, in the step of heating the layer of the film-forming composition to evaporate at least some of the water to obtain a film the layer of the film-forming composition is heated to a temperature and for a time such that the film contains less than or equal to about 75 wt percent of the polyhydric alcohol, more preferably less than or equal to about 70 wt percent of the polyhydric alcohol, even more preferably less than or equal to about 65 wt percent of the polyhydric alcohol. In some particularly preferred embodiments, in the step of heating the layer of the film-forming composition to evaporate at least some of the water to obtain a film the layer of the film-forming composition is heated to a temperature and for a time such that the film contains less than or equal to about 60 wt percent of the polyhydric alcohol.

Methods of manufacturing an aerosol-generating film in which a film-forming composition as described above is used have been found to be particularly easy to implement to form aerosol-generating films with good repeatability. Aerosol-generating films obtained by the methods described above have been found to provide satisfactory nicotine delivery to the consumer when heated to generate an aerosol. Further, it has been found that the tendency of the nicotine to evaporate during manufacturing, and particularly during the drying step that leads to the formation of the film itself from the film-forming composition, has been substantially countered by the inclusion of the acid.

Preferably, in methods in accordance with the invention a layer of the film-forming composition is formed that has a thickness of less than about 1 millimetre. Thus, an aerosol-generating film is obtained that has substantially the same thickness. More preferably, a layer of the film-forming composition is formed that has a thickness of less than about 0.75 millimetres. Even more preferably, a layer of the film-forming composition is formed that has a thickness of less than about 0.5 millimetres.

In particularly preferred embodiments, a layer of the film-forming composition is formed that has a thickness of less than or equal to about 400 micrometres, more preferably less than or equal to about 300 micrometres, even more preferably less than or equal to about 200 micrometres.

In addition, or as an alternative, a layer of the film-forming composition is formed that has a thickness of at least about 0.1 millimetres.

In preferred embodiments, a layer of the film-forming composition is formed that has a thickness from about 0.1 millimetres to about 1 millimetre, more preferably from about 0.1 millimetres to about 0.75 millimetres, even more preferably from about 0.1 millimetres to about 0.5 millimetres. In particularly preferred embodiments, a layer of the film-forming composition is formed that has a thickness from about 50 micrometres to 400 micrometres, more preferably from about 100 micrometres to 200 micrometres.

This is advantageous as the aerosol-generating film obtained under such circumstances has a thickness comparable to the thickness of cast leaf or reconstituted tobacco or other homogenised tobacco materials used for forming a substrate in an aerosol-generating article. Further, aerosol-generating films having a thickness falling within the ranges described above have been found to have sufficient strength whilst at the same time having a low weight, which helps decrease thermal inertia of the aerosol-generating substrate during use of an aerosol-generating article comprising the film as a substrate.

In some embodiments, the step of forming a layer of the film-forming composition comprises applying the film-forming composition on a substantially flat support surface.

This may, for example, be done by casting. Casting may be a simple way of processing the film-forming composition for obtaining the film. While it is typically a batch procedure used on a small scale, a continuous casting method (for example, based on knife-coating or tape-casting) may be used at the industrial scale, since the film-forming composition may be prepared on continuous carrier tapes such as to enable an effective control of the thickness of the layer. As an alternative, the film-forming composition may be formed into a layer having a predetermined thickness by extrusion.

The formed layer of film-forming composition can be dried by supplying heat to the layer by conduction, convection or radiation in relatively short times. The drying operation may, for example, be carried out by circulating a continuous carrier tape supporting the layer of film-forming composition in an oven or in a series of ovens. In general, the temperature to which the layer of the film-forming composition is heated may be adjusted depending on the content of water in the film-forming composition. Higher temperatures may typically result into a faster drying of the layer of film-forming composition. However, in those embodiments where the film-forming composition contains nicotine, an excessive supply of heat to the layer of film-forming composition may be undesirable.

In preferred embodiments, in the step of heating the layer of the film-forming composition to evaporate at least some of the water to obtain a film the layer of the film-forming composition is heated to at least about 50 degrees Celsius. More preferably, the layer of the film-forming composition is heated to at least about 60 degrees Celsius. Even more preferably, the layer of the film-forming composition is heated to at least about 70 degrees Celsius. Most preferably, the layer of the film-forming composition is heated to at least about 100 degrees Celsius.

In addition, or as an alternative, in the step of heating the layer of the film-forming composition to evaporate at least some of the water to obtain a film the layer of the film-forming composition is heated to less than about 140 degrees Celsius. More preferably, the layer of the film-forming composition is heated to less than about 130 degrees Celsius. Even more preferably, the layer of the film-forming composition is heated to less than about 120 degrees Celsius.

In preferred embodiments, in the step of heating the layer of the film-forming composition to evaporate at least some of the water to obtain a film the layer of the film-forming composition is heated to a temperature from about 50 degrees Celsius to about 140 degrees Celsius, more preferably from about 60 degrees Celsius to about 130 degrees Celsius, even more preferably from about 70 degrees Celsius to about 120 degrees Celsius. In particularly preferred embodiments, in the step of heating the layer of the film-forming composition to evaporate at least some of the water to obtain a film the layer of the film-forming composition is heated to a temperature from about 100 degrees Celsius to about 120 degrees Celsius.

In general, a layer of a film-forming composition as described above may be dried over a time ranging from a few minutes to several hours. This depends on both the content of water in the film-forming composition and on the temperature to which the layer of film-forming composition is heated. Further, the duration of the drying operation may also depend on the thickness of the layer of the film-forming composition. Without wishing to be bound by theory, it is understood that thinner layers may be dried more quickly as the amount of water to be evaporated per unit of surface area is lower compared with thicker layers. In other words, thinner layer have a lower water content/surface-area-available-for-heat-exchange ratio.

In some preferred embodiments, in the step of heating the layer of the film-forming composition to evaporate at least some of the water to obtain a film, a layer of the film-forming composition having a thickness from about 50 micrometres to about 400 micrometres is heated for a time from about 3.5 minutes to about 8 minutes to a temperature of about 140 degrees Celsius.

In a method in accordance with the present invention in the step of heating the layer of the film-forming composition to evaporate at least some of the water to obtain a film the layer of the film-forming composition is preferably heated to a temperature and for a time such that the film contains at least about 3 wt percent of water. In other words, it is preferable for the drying step to not evaporate all the water contained in the layer of the film-forming composition.

As mentioned previously, the step of preparing the film-forming composition preferably comprises: dissolving the cellulose based film-forming agent and the non-cellulose based thickening agent in the water to form a water-based preparation; and mixing the polyhydric alcohol into the water-based preparation to obtain the film-forming composition. In preferred embodiments, the step of preparing the film-forming composition further comprises defoaming the water-based preparation.

It has been observed that a foam may at times form when the various components are mixed to prepare the film-forming composition. The presence of foam may cause undesirably complicate the step of applying the film-forming composition by preventing the film forming composition to properly adhere to a supporting surface. Further, foam may cause defects on the outer surface of the film, such that it may be difficult to efficiently control the thickness of the layer of the film-forming composition formed on the supporting surface and consequently the thickness of the aerosol-generating film obtained after drying. The inventors have found that vacuum defoaming or the use of an anti-foaming agent or both may advantageously counter problems linked to foaming of the film-forming composition during mixing. Anti-foaming agents, also referred to as defoamers, are additives adapted to reduce and hinder the formation of foam in industrial process liquids. An anti-foaming agent may be added to water along with the other components of the film-forming composition with a view to preventing the formation of a foam altogether or added to the film-forming composition at a later stage to effectively break a foam already formed. Commonly used as anti-foaming agents are water-insoluble oils, polydimethylsiloxanes and other silicones, certain alcohols, stearates and glycols.

Preferably, in the step of heating the layer of the film-forming composition to evaporate at least some of the water to obtain a film, the layer of the film-forming composition is heated to a temperature and for a time such that at least about 20 wt percent of the water in the film-forming composition is evaporated. More preferably, the layer of the film-forming composition is heated to a temperature and for a time such that at least about 30 wt percent of the water in the film-forming composition is evaporated. Even more preferably, the layer of the film-forming composition is heated to a temperature and for a time such that at least about 40 wt percent of the water in the film-forming composition is evaporated.

In particularly preferred embodiments, the layer of the film-forming composition is heated to a temperature and for a time such that at least about 50 wt percent of the water in the film-forming composition is evaporated, more preferably at least about 60 wt percent of the water in the film-forming composition is evaporated, even more preferably at least about 70 wt percent of the water in the film-forming composition is evaporated.

Preferably, in the step of heating the layer of the film-forming composition to evaporate at least some of the water to obtain a film, the layer of the film-forming composition is heated to a temperature and for a time such less than or equal to 90 wt percent of the water in the film-forming composition is evaporated, more preferably less than or equal to 85 wt percent of the water in the film-forming composition is evaporated, even more preferably less than or equal to 80 wt percent of the water in the film-forming composition is evaporated.

In preferred embodiments, in the step of heating the layer of the film-forming composition to evaporate at least some of the water to obtain a film, from about 40 wt percent to about 90 wt percent of the water in the film-forming composition is evaporated, more preferably from about 50 wt percent to about 85 wt percent of the water in the film-forming composition, even more preferably from about 60 wt percent to about 80 wt percent of the water in the film-forming composition.

Preferably, in the step of heating the layer of the film-forming composition to evaporate at least some of the water to obtain a film, the layer of the film-forming composition is heated to a temperature and for a time such that the film contains less than or equal to about 25 wt percent of water, more preferably less than or equal to about 20 wt percent of water, even more preferably less than or equal to about 15 wt percent of water.

Preferably, in the step of heating the layer of the film-forming composition to evaporate at least some of the water to obtain a film, the layer of the film-forming composition is heated to a temperature and for a time such that the film contains at least about 5 wt percent of water.

In general, it has been observed that the presence of some residual water imparts some desirable stability to the aerosol-generating film. At the same time, a residual content of water of 25 wt percent less is desirable as an aerosol-generating film may be obtained that is not particularly sticky. Further, when heating an aerosol-generating film with a smaller residual water content, an aerosol more concentrated in the polyhydric alcohol and, where present, in an alkaloid, such as nicotine, may be provided to the consumer.

In preferred embodiments, in the step of heating the layer of the film-forming composition to evaporate at least some of the water to obtain a film, the layer of the film-forming composition is heated to a temperature and for a time such that the film contains from about 5 wt percent to about 25 wt percent of water, more preferably from about 10 wt percent to about 20 wt percent water.

Films obtained by a method in accordance with the invention preferably have a basis weight of at least about 100 grams per square metre. More preferably, films obtained by a method in accordance with the invention have a basis weight of at least about 120 grams per square metre. Even more preferably, films obtained by a method in accordance with the invention have a basis weight of at least about 140 grams per square metre.

Films obtained by a method in accordance with the invention preferably have a basis weight less than or equal to 300 grams per square metre. More preferably, films obtained by a method in accordance with the invention have a basis weight less than or equal to 280 grams per square metre. Even more preferably, films obtained by a method in accordance with the invention have a basis weight less than or equal to 260 grams per square metre.

In preferred embodiments, films obtained by a method in accordance with the invention have a basis weight from about 100 grams per square metre to about 300 grams per square metre, more preferably from about 120 grams per square metre to about 280 grams per square metre, even more preferably from about 140 grams per square metre to about 260 grams per square metre. In particularly preferred embodiments, films obtained by a method in accordance with the invention have a basis weight of about 200 grams per square metre.

Films obtained by the methods described above may find use as aerosol-generating substrates for aerosol-generating articles of the type wherein the substrate is heated to release an inhalable aerosol—as opposed to articles wherein a substrate is burned to produce an inhalable smoke.

Methods in accordance with the invention make it possible for aerosol-generating films to be easily manufactured and enable fine control of both composition and geometrical parameters of the aerosol-generating films. In more detail, controlled amounts of a the film-forming composition may be applied with precision on a supporting surface to form films at predetermined locations. Further, the formulation of the films—especially as regards the content of the polyhydric alcohol and, where present, of the nicotine or plant material (including both tobacco and non-tobacco plant material)—can be finely tuned and controlled. Accordingly, methods in accordance with the invention provide aerosol-generating films that are versatile and can be used as substrates in a number of forms. By way of example, films obtained by methods in accordance with the invention may be used as aerosol-generating substrates in supported form as well as in self-supporting form. Further, films obtained by methods in accordance with the invention may be used in different shapes and sizes, such that an exposed surface area of the film can also be adjusted and tailored to specific uses and needs.

By way of example, an aerosol-generating film obtained by a method in accordance with the invention may be provided on the inner surface of a tubular carrier element, such that the outer surface of the aerosol-generating film is exposed inside the longitudinal internal channel defined by the tubular carrier element. Upon heating, an aerosol can be generated from the aerosol-generating film, which is thus released into the internal channel and can be drawn through the aerosol-generating article into the consumer's mouth.

As an alternative, an aerosol-generating film obtained by a method in accordance with the invention may be configured such that it forms a self-supporting rod and no additional support structures are required within the aerosol-generating substrate. By way of example, one or more aerosol-generating films obtained by a method in accordance with the invention may be gathered to form a rod of aerosol-generating substrate. Alternatively, a plurality of films obtained by a method in accordance with the invention may be stacked into a rod of aerosol-generating substrate. In a further alternative arrangement, a plurality of strips or shreds of an aerosol-generating film obtained by a method in accordance with the invention may be aligned, brought together and wrapped to form a rod of aerosol-generating substrate. Alternatively, the strips or shreds of aerosol-generating film may be randomly oriented within the rod.

The invention will now be further described with reference to the following

EXAMPLES

Table 1 describes the composition of aerosol-generating films, along with the formulation of film-forming compositions from which the aerosol-generating films are obtained.

TABLE 1

| Example | Film-forming composition (w/w) | Aerosol-generating film composition (w/w) |
|---|---|---|
| 1 | 4.41% HPMC | 19.27% HPMC |
| | 1.10% Agar | 4.8% Agar |
| | 0.33% Nicotine | 1.44% Nicotine |
| | 11% Glycerin | 48% Glycerin |
| | 0.47% Levulinic acid | 2.07% Levulinic acid |
| | 82.69% Water | 24.42% Water |
| 2 | 6.03% HPMC | 20.38% HPMC |
| | 1.51% Agar | 5.09% Agar |
| | 0.5% Nicotine | 1.70% Nicotine |
| | 15.07% Glycerin | 50.94% Glycerin |
| | 0.56% Levulinic acid | 1.89% Levulinic acid |
| | 76.34% Water | 20% Water |
| 3 | 7.75% HPMC | 11.04% HPMC |
| | 2.33% Agar | 3.31% Agar |
| | 1.47% Nicotine | 2.10% Nicotine |
| | 46.51% Glycerin | 66.22% Glycerin |
| | 1.64% Levulinic acid | 2.33% Levulinic acid |
| | 40.30% Water | 15% Water |

Aerosol-generating films are manufactured based on the compositions in Table 1. To this purpose, the HPMC and agar are mixed in glycerin using heat and agitation until dissolution. Water, nicotine and levulinic acid are then added under agitation until dissolution. A layer of the film-forming composition thus obtained is formed on a plane surface and left to solidify. The layer of film-forming composition is formed with a thickness of about 210 micrometres. The layer of film-forming composition thus formed is heated to about 140 degrees Celsius for about 8 minutes.

The aerosol-generating film obtained after drying is solid. In other words, the aerosol-generating film has a stable size and shape and does not flow. The term "stable" is used herein to indicate that the aerosol-generating film obtained by a method in accordance with the invention substantially maintains its shape and mass when exposed to a variety of environmental conditions. As such, it substantially does not release or absorb water when exposed to standard temperature and pressure while varying the relative humidity from about 10 percent to about 60 percent.

This is particularly advantageous as it ensures that films obtained by methods in accordance with the present invention do not release a liquid phase during storage or transportation, for example, from the manufacturing facility to a point of sale.

The aerosol-generating films prepared as described above are heated to a temperature from about 180 degrees Celsius to about 250 degrees Celsius to simulate the conditions of use in an aerosol-generating device. The nicotine, glycerin and water contained in the film evaporate. The nicotine and glycerin condense to form an inhalable aerosol. The aerosol-generating film shrinks slightly and its volume is reduced. However, the film remains solid and maintains its film form. It appears to harden slightly and to take on a darker, brownish colour.

The invention claimed is:

1. A method of manufacturing an aerosol-generating film for generating an aerosol upon heating, the method comprising:

preparing a film-forming composition comprising:

a cellulose based film-forming agent, a non-cellulose based thickening agent, at least about 30 wt percent of water, and at least about 20 wt percent of a polyhydric alcohol, wherein the polyhydric alcohol is glycerin;

forming a layer of the film-forming composition, the layer having a thickness of less than 1 millimeter; and heating the layer of the film-forming composition to evaporate at least some of the water to obtain the aerosol-generating film, wherein the layer of the film-forming composition is heated to a temperature and for a time such that the aerosol-generating film contains less than or equal to about 30 wt percent of water, wherein the step of preparing the film-forming composition further comprises:

dissolving the cellulose based film-forming agent and the non-cellulose based thickening agent in the water to form a water-based preparation, defoaming the water-based preparation, and mixing the polyhydric alcohol into the water-based preparation to obtain the film-forming composition.

2. The method according to claim 1, wherein the cellulose based film-forming agent is selected from the group consisting of hydroxypropyl methylcellulose (HPMC), methylcellulose, and combinations thereof.

3. The method according to claim 1, wherein the film-forming composition comprises at least 4 wt percent of the cellulose based film forming agent.

4. The method according to claim 1, wherein the non-cellulose based thickening agent is selected from the group consisting of agar, xanthan gum, alginate, and combinations thereof.

5. The method according to claim 1, wherein the film-forming composition further comprises an alkaloid compound, or a cannabinoid compound, or a plant material, or a non-tobacco plant extract, or a combination thereof.

6. The method according to claim 1, wherein the film-forming composition further comprises nicotine.

7. The method according to claim 1, wherein the film-forming composition further comprises an acid.

8. The method according to claim 7, wherein the acid is lactic acid or levulinic acid.

9. The method according to claim 1, wherein the film-forming composition consists of:

from about 3 wt percent to about 6 wt percent HPMC, from about 0.5 wt percent to about 2 wt percent agar, from about 0.1 wt percent to about 2 wt percent nicotine, from about 0.1 wt percent to about 1 wt percent of an acid, about 20 wt percent glycerin, and balance water.

10. The method according to claim 1, wherein in the step of heating the layer of the film-forming composition to evaporate at least some of the water to obtain the aerosol-generating film, the layer of the film-forming composition is heated to a temperature and for a time such that the film contains at least about 40 wt percent of the polyhydric alcohol.

11. The method according to claim 1, wherein the step of forming the layer of the film-forming composition comprises applying the film-forming composition on a substantially flat support surface.

12. The method according to claim 1, wherein in the step of heating the layer of the film-forming composition to evaporate at least some of the water to obtain the aerosol-generating film, the layer of the film-forming composition is heated to at least about 50 degrees Celsius.

13. The method according to claim 1, wherein in the step of heating the layer of the film-forming composition to evaporate at least some of the water to obtain the aerosol-generating film, the layer of the film-forming composition is heated to less than or equal to about 140 degrees Celsius.

14. The method according to claim 1, wherein in the step of heating the layer of the film-forming composition to evaporate at least some of the water to obtain the aerosol-generating film, the layer of the film-forming composition is heated to a temperature and for a time such that the film contains at least about 3 wt percent of water.

15. The method according to claim 1, wherein in the step of heating the layer of the film-forming composition to evaporate at least some of the water to obtain the aerosol-generating film, the layer of the film-forming composition is heated to a temperature and for a time such that at from about 40 wt percent to about 90 wt percent of the water in the film-forming composition is evaporated.

16. The method according to claim 1, wherein in the step of heating the layer of the film-forming composition to evaporate at least some of the water to obtain the aerosol-generating film, the layer of the film-forming composition is heated to a temperature and for a time such that the film contains from about 5 wt percent to about 25 wt percent of water.

* * * * *